US012060994B2

(12) United States Patent
Pawar

(10) Patent No.: US 12,060,994 B2
(45) Date of Patent: Aug. 13, 2024

(54) USING DIODE RECTIFICATION TO DETERMINE IGNITER, INDUCER RELAY, AND IGNITER RELAY FAULTS

(71) Applicant: COPELAND COMFORT CONTROL LP, St. Louis, MO (US)

(72) Inventor: Harshal Manik Pawar, Pune (IN)

(73) Assignee: Copeland Comfort Control LP, St. Louis, MO (US)

( * ) Notice: Subject to any disclaimer, the term of this patent is extended or adjusted under 35 U.S.C. 154(b) by 0 days.

(21) Appl. No.: 18/377,678

(22) Filed: Oct. 6, 2023

(65) Prior Publication Data

US 2024/0044491 A1 Feb. 8, 2024

Related U.S. Application Data

(63) Continuation of application No. 17/356,061, filed on Jun. 23, 2021, now Pat. No. 11,781,752.

(51) Int. Cl.

| | |
|---|---|
| ***F23Q 23/10*** | (2006.01) |
| ***F23N 5/24*** | (2006.01) |
| ***F23N 5/26*** | (2006.01) |
| ***F24H 9/20*** | (2022.01) |

(52) U.S. Cl.

CPC ..... *F23Q 23/10* (2013.01); *F23N 5/242* (2013.01); *F23N 5/265* (2013.01); *F24H 9/2071* (2013.01); *F23N 2231/12* (2020.01)

(58) Field of Classification Search

CPC ..... F24H 9/2071; F23N 5/265; F23N 5/242; F23Q 23/10

USPC ..... 431/18–90

See application file for complete search history.

(56) References Cited

U.S. PATENT DOCUMENTS

| | | | | |
|---|---|---|---|---|
| 9,518,763 | B2 | 12/2016 | Broker et al. | |
| 10,352,588 | B2 | 7/2019 | Broker | |
| 10,508,831 | B2 | 12/2019 | Broker et al. | |
| 11,781,752 | B2 * | 10/2023 | Pawar | F23N 5/265 431/26 |
| 2018/0306445 | A1 | 10/2018 | Pawar | |

* cited by examiner

*Primary Examiner* — Vivek K Shirsat

(74) *Attorney, Agent, or Firm* — Harness, Dickey & Pierce, P.L.C.; Anthony G. Fussner

(57) ABSTRACT

Exemplary embodiments are disclosed of controls including circuit assemblies configured for determining igniter, inducer relay, and igniter relay faults. In exemplary embodiments, a control for a system includes an input configured to receive a control signal, an inducer relay, an igniter relay, and a circuit assembly. The circuit assembly is configured to be coupled to the inducer relay, the igniter relay, and an igniter of the system. The circuit assembly comprises a plurality of diodes and is configured to enable detection of and distinguishing between a failure of the igniter, a failure of the inducer relay, and a failure of the igniter relay as determined by a waveform of the control signal at the input of the control for a given one of a plurality of operational states of the control.

24 Claims, 19 Drawing Sheets

Control in Idle State
Inducer Relay and Igniter Relay are OFF with Igniter Installed Waveform: Control in Idle State
No Faults Detected Waveform: Control in Idle State
Inducer Relay ON when Inducer Relay should be OFF Waveform: Control in Idle State
Igniter Open/Absent Fault Waveform: Control in Idle State
Reverse Line Polarity Fault Waveform: Control in Idle State
'Igniter Open in Reverse Line Polarity' Fault Waveform: Control in Pre-Purge State
Inducer Relay ON, Working Properly Waveform: Control in Pre-Purge
'Inducer Relay OFF when Inducer Relay should be ON' Fault Waveform: Control in Pre-Purge
'Igniter Relay ON when Igniter Relay should be OFF' Fault Waveform: Control in Warm-Up
No Faults Detected Waveform: Control in Warm-Up
'Igniter Relay OFF when Igniter Relay should be ON' Fault When Inducer Relay is OFF When Inducer Relay is ON

USING DIODE RECTIFICATION TO DETERMINE IGNITER, INDUCER RELAY, AND IGNITER RELAY FAULTS

CROSS-REFERENCE TO RELATED APPLICATION

This application is a continuation of U.S. patent application Ser. No. 17/356,061 filed Jun. 23, 2021, which published as US2022/0412559 on Dec. 29, 2022 and issues as U.S. Pat. No. 11,781,752 on Oct. 10, 2023. The entire disclosure of the above Patent application is incorporated herein by reference.

FIELD

The present disclosure relates to using diode rectification to determine igniter, inducer relay, and igniter relay faults or failures.

BACKGROUND

This section provides background information related to the present disclosure which is not necessarily prior art.

Gas powered appliances, such as gas powered furnaces, often include a hot surface igniter that heats up based on a supplied current to ignite a combustible gas. An igniter relay and an inducer relay may be used to selectively connect the hot surface igniter to the power source that supplies the current to the igniter. Failure of the hot surface igniter, the igniter relay, or an inducer relay can cause a failure of the gas powered appliance. And it may be difficult to determine which of the hot surface igniter, the igniter relay, or the inducer relay has failed.

DRAWINGS

The drawings described herein are for illustrative purposes only of selected embodiments and not all possible implementations, and are not intended to limit the scope of the present disclosure.

FIG. 10 is a circuit diagram of the control shown in FIG. 1, where the control is in pre-purge state and the inducer relay is stuck OFF when the inducer relay should be ON.

FIG. 15 is a circuit diagram of the control shown in FIG. 1, where the control is in igniter warm-up state and the igniter relay is stuck OFF when the igniter relay should be ON.

Figure 19:
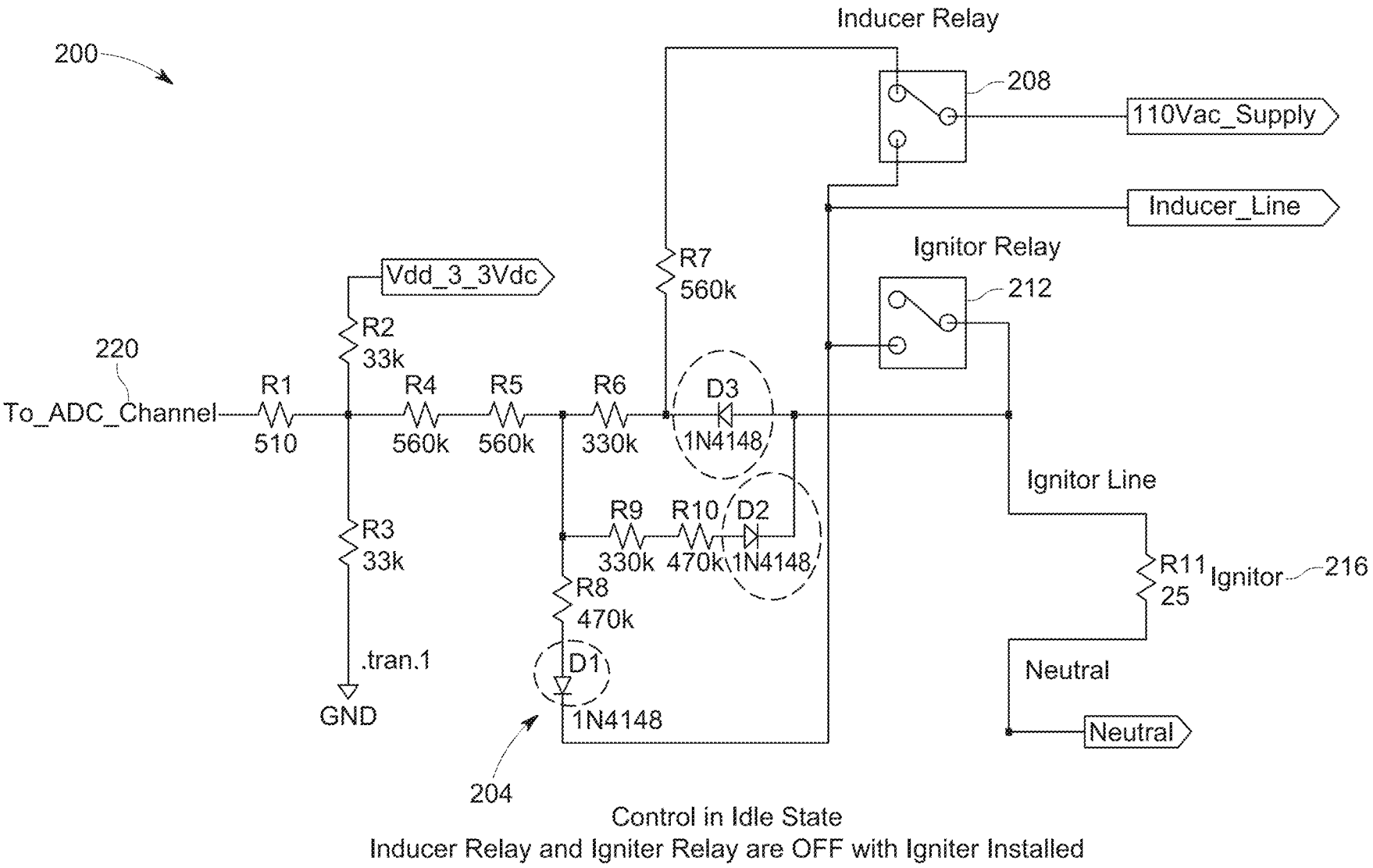

FIG. 19 is a circuit diagram of a control including a circuit assembly enabling use of diode rectification to determine igniter, inducer relay, and igniter relay faults according to an alternative exemplary embodiment of the present disclosure. In this alternative exemplary embodiment, the direction of the diodes D1, D2, D3 has been reversed as compared to the diodes D1, D2, D3 in the circuit assembly shown in FIG. 1.

Corresponding reference numerals may indicate corresponding (though not necessarily identical) features throughout the several views of the drawings.

DETAILED DESCRIPTION

Example embodiments will now be described more fully with reference to the accompanying drawings.

As noted above, the failure of a hot surface igniter, an igniter relay, or an inducer relay can cause a failure of a gas powered appliance. And it may be difficult to determine which of the hot surface igniter, the igniter relay, or the inducer relay has failed.

Conventionally, the inducer must be turned ON to detect an igniter open fault. The analog signal is used as the feedback to detect igniter fault and igniter relay fault. The amplitude of the analog signal changes when switching the inducer relay and then again when switching the igniter relay. The amplitude of the analog signal also changes when the igniter is not present.

As recognized herein, there are several disadvantages associated with this conventional method to detect an igniter open fault in addition to having to turn ON the inducer. For example, the feedback signal varies as line voltage changes (80 Vac to 135 Vac) such that this conventional method is unable to accurately detect relay and igniter fault. Signal overlap could occur when line voltage changes, such that there may be a failure in fault detection and reporting of false faults. Grounding voltage affects fault detection, which may inhibit or prevent precisely detecting relay and igniter faults when grounding voltage is present. When the inducer relay is ON, grounding voltage cannot be checked which inhibits or prevents reliable detection of fault during grounding voltage.

After recognizing the above, exemplary embodiments were developed and/or disclosed herein of methods and controls including circuit assemblies configured for determining igniter, inducer relay, and igniter relay faults were developed and/or are disclosed herein. In exemplary embodiments, diode rectification is used to detect relay status (ON or OFF) and igniter open fault identification. By using diode rectification, the waveform of a signal at the control input (e.g., microcontroller input pin, etc.) will be positive half cycle or negative half cycle depending upon relay status ON or OFF. By analyzing the waveform of the control input signal, a conclusion can be made whether the relay is operating correctly or is faulty. Also, using diode rectification enables the detection of the presence or absence (e.g., damaged, not installed) of an igniter. This helps to diagnose the fault condition correctly so that a technician can take corrective action.

In exemplary embodiments, the following faults can be determined (e.g., detected, identified, distinguished): inducer relay fault, igniter relay fault, igniter open/absent fault and reverse line polarity fault. Grounding voltage is also measurable during standby and heating operation. Exemplary embodiments disclosed herein may provide or include one or more of the following features/advantages. Line voltage fluctuations or change does not affect fault detection, such that the fault detection is very reliable and accurate (e.g., 100% accurate). Grounding voltage can be measured when the inducer relay is ON or OFF. The heat cycle does not need to be started if there is an igniter open/absent fault, thereby eliminating the need to turn on the unnecessary inducer. Separate hardware for grounding voltage measurement is not required.

Figure 1:
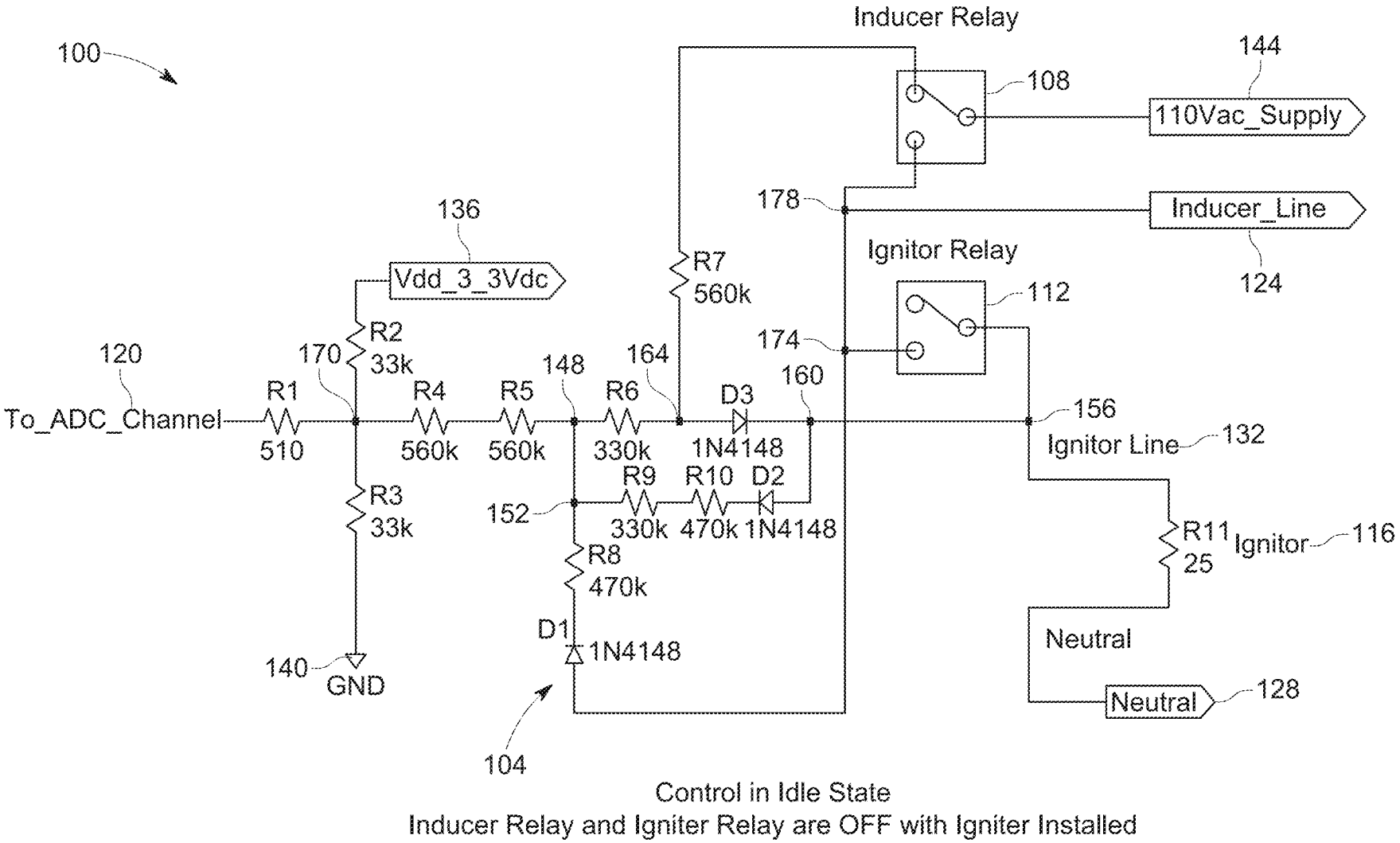
FIG. 1 is a circuit diagram of a control including a circuit assembly configured for determining igniter, inducer relay, and igniter relay faults according to an exemplary embodiment of the present disclosure. As shown, the control is in idle state, the inducer relay and igniter relay are OFF, and an igniter is installed.

FIG. 1 is a circuit diagram of a control 100 including a circuit assembly 104 enabling use of diode rectification to determine igniter, inducer relay, and igniter relay faults according to an exemplary embodiment of the present disclosure. As shown, the control 100 is in idle state, the inducer relay 108 and igniter relay 112 are OFF, and the igniter 116 is installed.

As shown in FIG. 1, the terminals of the inducer relay 108 and the igniter relay 112 are shorted such that the inducer relay 108 and igniter relay 112 are OFF.

The circuit assembly 104 is configured to be coupled to the inducer relay 108, the igniter relay 112, and the igniter 116. The circuit assembly 104 includes a plurality of diodes D1, D2, and D3 and a plurality of resistors (broadly, resistances) R1 through R11. By way of example only, the diodes D1, D2, and D3 may comprise standard signal diodes, e.g., 1N4148 standard signal diodes, etc. Also by way of example only, FIG. 1 provides resistances for the resistors R1 through R11, but other embodiments may use any other suitable resistance values for any one or more of the resistors R1 through R11.

As disclosed herein, the circuit assembly 104 is configured to enable detection of and distinguishing between a failure of the igniter 116, a failure of the inducer relay 108, and a failure of the igniter relay 112 as determined (e.g., by using an oscilloscope, etc.) by a waveform of the control signal at an input 120 of the control 100 for a given one of a plurality of operational states of the control including an idle state, a pre-purge state, and an igniter warm-up state.

In this illustrated embodiment, the first diode D1 is coupled in series with resistor R8. The first diode D1 is coupled in series with the input 120 of the control 100 via a path through the resistors R8, R5, R4, and R1. The first diode D1 is coupled with the ON terminal of the igniter relay 112, an inducer line 124, and the ON terminal of the inducer relay 108.

The second diode D2 is coupled in series with resistors R10 and R9. The second diode D1 is coupled in series with the input 120 of the control 100 via a path through the resistors R10, R9, R5, R4, and R1. The second diode D2 is coupled to the igniter relay 112. The second diode D2 is coupled to neutral 128 via a path through the igniter line 132 and the igniter 116.

The third diode D3 is coupled in parallel with the second diode D2. The third diode D1 is coupled in series with the resistor R6. The third diode D3 is coupled in series with the input 120 of the control 100 via a path through resistors R6, R5, R4, and R1. The third diode D3 is coupled to the igniter relay 112. The third diode D3 is coupled to neutral via a path through the igniter line 132 and the igniter 116. The third diode D3 is coupled with the OFF terminal of the inducer relay 108 via a path through resistor R7.

The input 120 of the control 100 is coupled in series with a voltage source 136 (e.g., Vdd_3_3 VDc) via a path through resistor R2. The input 120 of the control 100 is coupled in series with ground 140 via a path through resistor R3.

The inducer relay 108 is coupled to a voltage source 144. The voltage source 144 may include any suitable source for supplying voltage and/or current to the igniter 116, including but not limited to, a power supply, a line voltage input, a utility grid voltage supply, etc. In this exemplary embodiment, the voltage source 144 is illustrated as a line voltage input of about 110 volts alternating current (Vac).

The inducer relay 108 and the igniter relay 112 are configured to be operable for selectively connecting the igniter 116 to the voltage source 144 for supplying power to the igniter 116. The inducer relay 108 and igniter relay 112 may be selectively turned on and off (e.g., opened and closed, etc.) via a control signal, which may be provided by control 100 or by another controller (e.g., furnace controller, thermostat, etc.) which is not shown in FIG. 1, etc. For example, the relays 108, 112 may be turned on (e.g., closed, etc.) in response to a call for initiation or startup of a combustion process of a furnace (e.g., a call for heat, etc.), where the relays 108, 112 starts to supply current and/or voltage from the voltage source 144 to the igniter 116. The relays 108, 112 may include any suitable relay element, switch element, etc., capable of selectively providing current from the voltage source 144 to the igniter 116.

A node 148 is defined between the input 120 of the control 100 and the first, second, and third diodes D1, D2, and D3. A node 152 is defined between the node 148 and the first and second diodes D1 and D2. A node 156 is defined between the igniter relay 112 and the igniter line 132. A node 160 is defined between the node 156 and the second and third diodes D2 and D3. A node 164 is defined between the inducer relay 108, the third diode D3, and the node 148. A node 170 is defined between the input 120 of the control 100, the voltage source 136, ground 140, and the node 148. A node 174 is defined between the first diode D1, the ON terminal of the igniter relay 112 and a node 178. The node 178 is defined between the inducer line 124, the ON terminal of the inducer relay 108, and the node 174.

Figure 2:
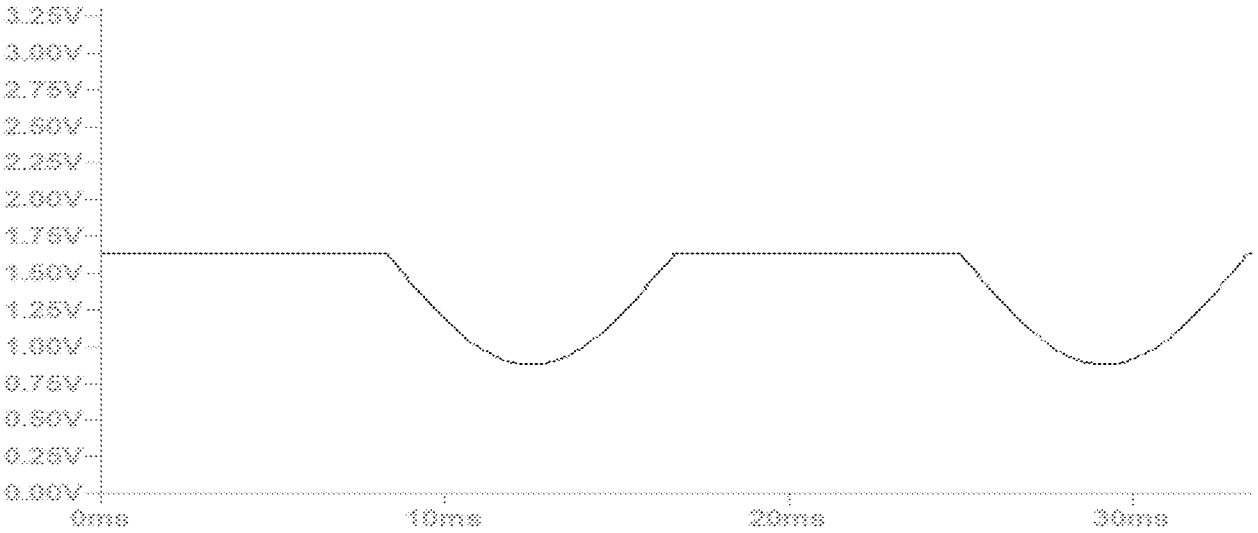
FIG. 2 illustrates a waveform of a signal in volts (V) versus time in milliseconds (ms) at an input of the control shown in FIG. 1 that indicates no faults.

When the control 100 is in idle state and there is not any fault or failure of the inducer relay 108, igniter relay 112, and igniter 116, then the signal at the control input 120 will have a negative half cycle as shown in FIG. 2. See also Table 1 below. When the inducer relay 108 and igniter relay 112 are OFF, the positive half cycle passes through the igniter 116 to neutral such that only the negative half cycle is at the control input 120.

TABLE 1

| Not any fault | |
|---|---|
| Which Relay | Relay actual status in hardware |
| Inducer Relay | OFF |
| Igniter Relay | OFF |
| Igniter | Present |
| Fault Detected → | Not any fault |

Figure 3:
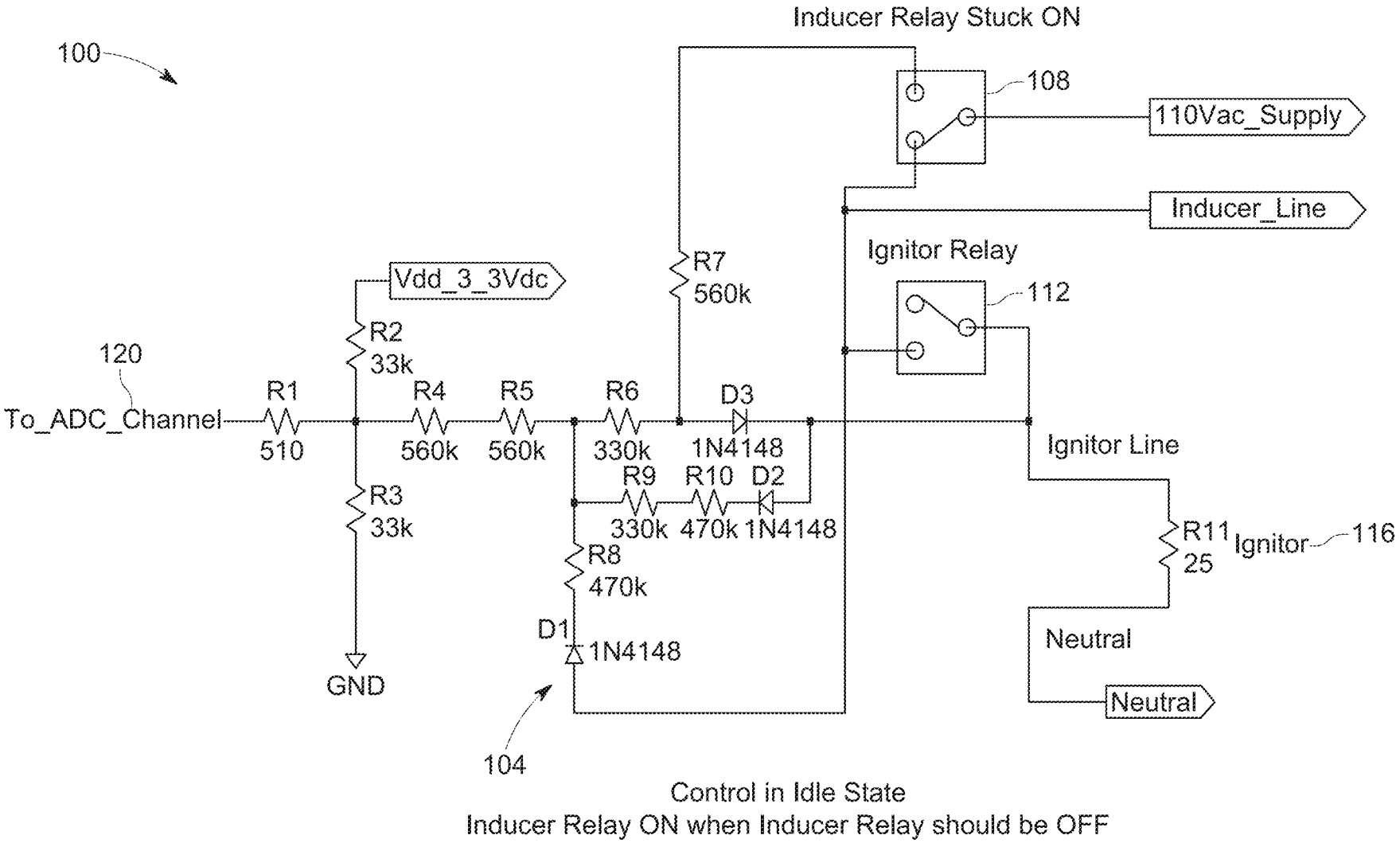
FIG. 3 is a circuit diagram of the control shown in FIG. 1, where the control is in idle state and the inducer relay is stuck ON when the inducer relay should be OFF.

When the control 100 is in idle state, the following three faults are detectable (1) Inducer Relay ON when Inducer Relay should be OFF, (2) Igniter Open, and (3) Reverse Line Polarity. For example, FIG. 3 illustrates the control 100 in idle state when the inducer relay 108 is stuck ON when the inducer relay 108 should be OFF. See TABLE 2 below.

TABLE 2

| Inducer Relay ON when Inducer Relay should be OFF | |
|---|---|
| Which Relay | Relay actual status in hardware |
| Inducer Relay | Turned OFF - Found ON |
| Igniter Relay | OFF |
| Igniter | Present or Absent |
| Fault Detected → | Inducer Relay ON when Inducer Relay should be OFF |

Figure 4:
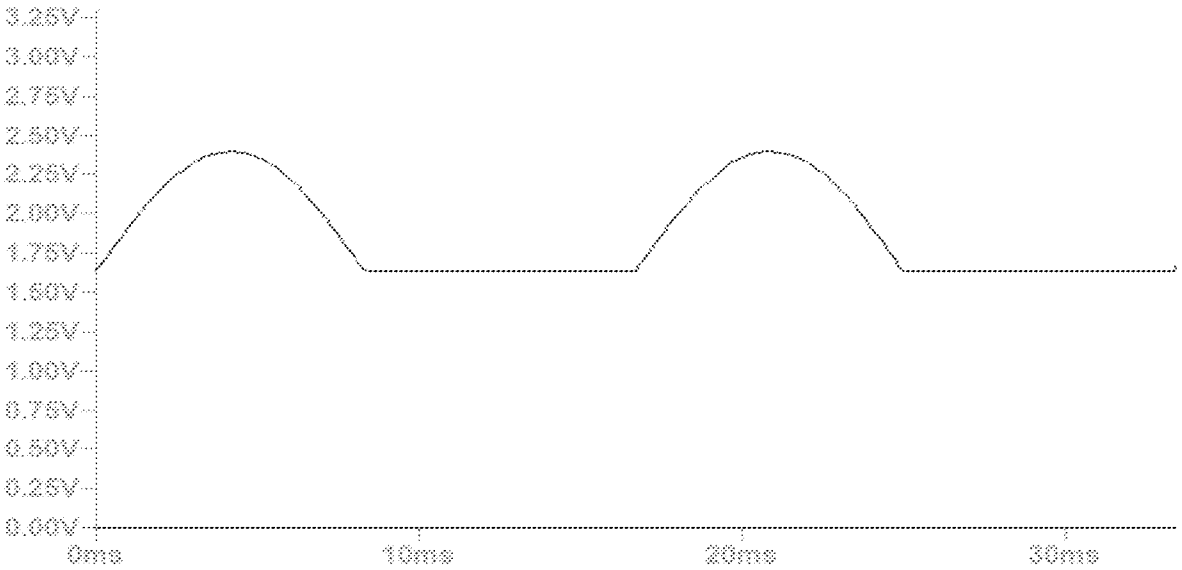
FIG. 4 illustrates a waveform of a signal at the input of the control shown in FIG. 3 in idle state that indicates an 'Inducer Relay is ON when Inducer Relay should be OFF' fault.

FIG. 4 illustrates a positive half cycle waveform of a signal at the control input 120 when the control 100 is in idle state, which indicates that the inducer relay 108 is ON when the inducer relay 108 should be OFF. When the inducer relay 108 is ON, the circuit assembly 104 passes only the positive half cycle to the control input 120 while blocking negative half cycle. Therefore, the conclusion can be made that the inducer relay 108 is ON. This is because if the inducer relay 108 was OFF, the inducer relay 108 would only pass the negative half cycle to the control input 120 while passing positive half cycle to neutral. Accordingly, it is possible to detect inducer relay ON should be OFF fault when control is in idle state.

Figure 5:
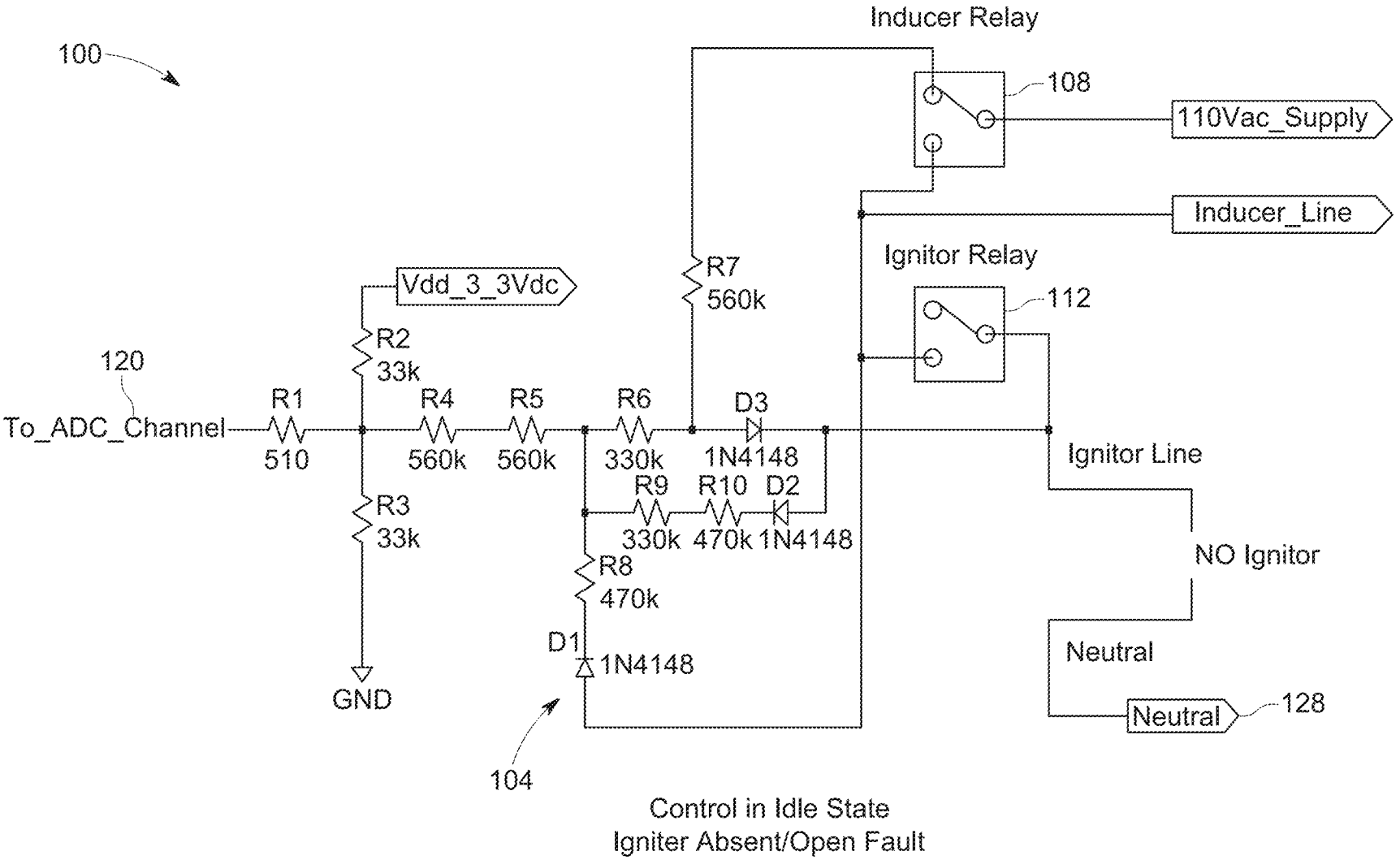
FIG. 5 is a circuit diagram of the control shown in FIG. 1, where the control is in idle state and the igniter is absent, i.e., igniter open fault.

FIG. 5 illustrates the control 100 in idle state when the igniter 116 is absent, i.e., igniter open fault. See TABLE 2 below.

TABLE 3

| Igniter Absent/Open | |
|---|---|
| Which Relay | Relay actual status in hardware |
| Inducer Relay | OFF |
| Igniter Relay | OFF or ON<br>(No impact on Igniter fault detection) |

TABLE 3-continued

| Igniter Absent/Open | |
|---|---|
| Which Relay | Relay actual status in hardware |
| Igniter | Absent |
| Fault Detected → | Igniter Open Error |

Figure 6:
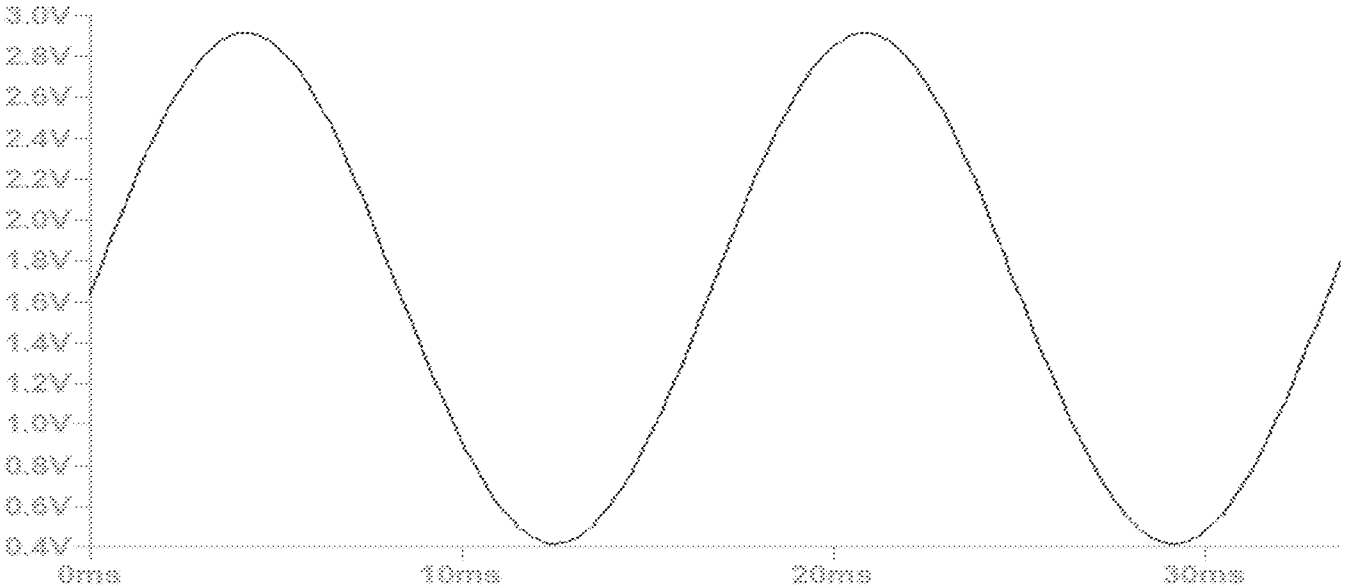
FIG. 6 illustrates a waveform of a signal at the input of the control shown in FIG. 5 in idle state that indicates an 'Igniter Open' fault.

FIG. 6 illustrates a full cycle waveform of a signal at the control input 120 when the control 100 is in idle, which indicates an 'Igniter Open' fault. Igniter open fault can be detected when inducer relay 108 is OFF, i.e., when control is in idle state. This allows igniter relay fault and igniter open fault to be isolated or distinguished from each other. It is not necessary to run the heat cycle when there is no igniter 116 installed as the igniter 116 can be detected before the inducer relay 108 is turned ON and the control 100 is in idle state.

During control idle state when the igniter 116 is absent, e.g., not installed or burnt (circuit open), a full cycle is at the control input 120. Due to the absence of the igniter 116, there is no path for the positive cycle to pass to neutral 128. In which case, the full cycle is at control input 120 thereby indicating the igniter 116 is absent, e.g., not installed or burnt (circuit open).

This signal for igniter absence is not being affected by the igniter relay 112 whether it is ON or OFF (stuck closed or stuck open). Therefore, it is possible to detect igniter open error when the inducer relay 108 is OFF irrespective of the status of igniter relay 112. Accordingly, this enables accurate differentiation (e.g., 100% reliability) of igniter absent/open fault from igniter relay fault when the inducer relay 108 is OFF.

Figure 7:
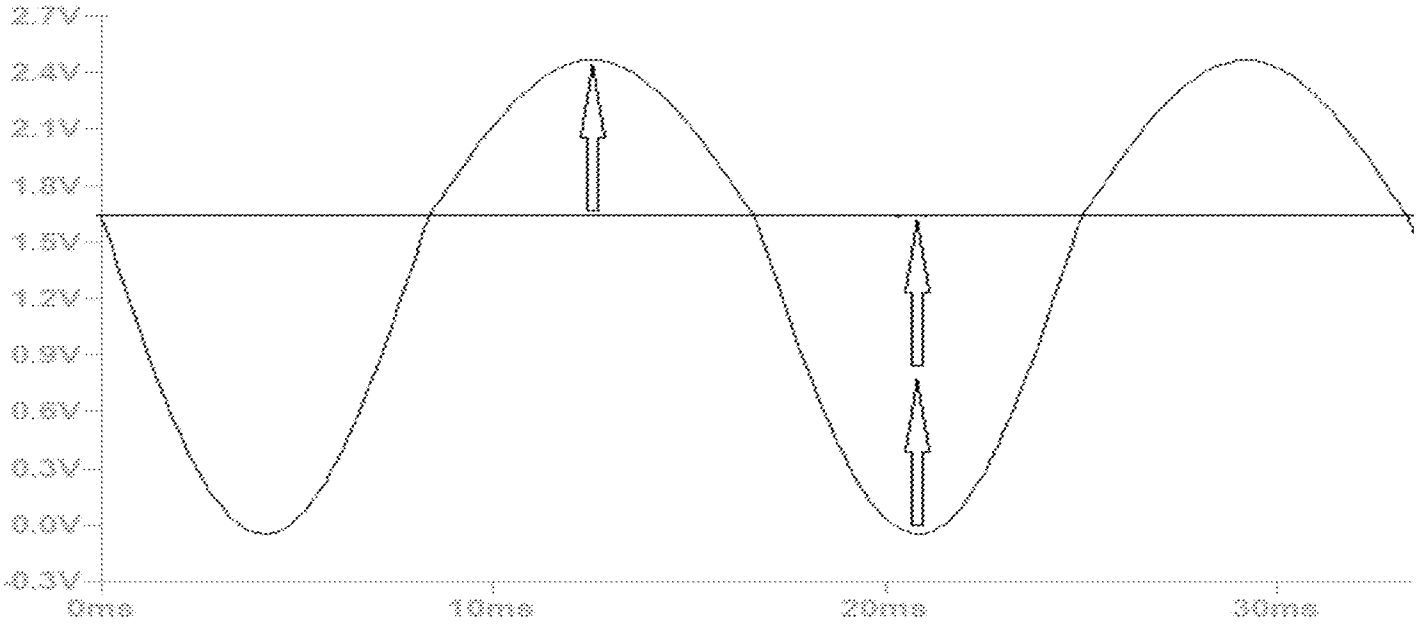
FIG. 7 illustrates a waveform of a signal at the input of the control shown in FIG. 1 in idle state that indicates a 'Reverse Line Polarity' fault and that the igniter is present.

FIG. 7 illustrates a waveform of a signal at the control 120 when the control 100 is in idle state, which indicates a reverse line polarity fault and that the igniter 116 is present. In this example, the control 100 receives a neutral terminal signal through the igniter 116 in order to detect reverse line polarity, igniter should be present. If the 110 Vac power supply wiring has been reversed (i.e., control board neutral terminal is connected to 110 Vac hot and board line terminal is connected to neutral terminal of power supply), then the control 100 would receive a signal at the control input 120 as shown in FIG. 7 wherein the positive half cycle signal amplitude is approximately one-half of the amplitude of the negative half cycle.

Figure 8:
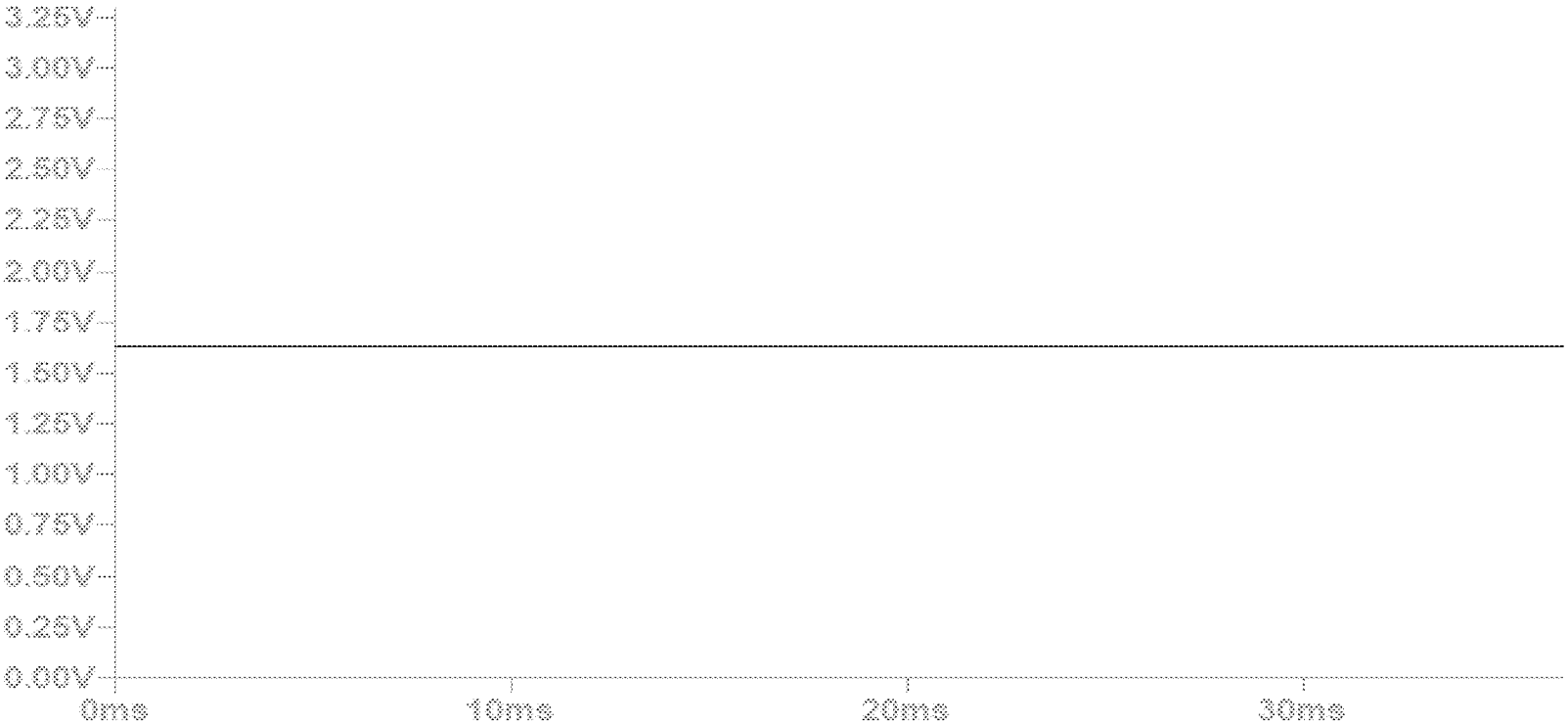
FIG. 8 illustrates a waveform of a signal at the input of the control shown in FIG. 1 in idle state that indicates a 'Reverse Line Polarity' fault and igniter absent/open.

FIG. 8 illustrates a waveform of a signal at the control input 120 when the control 100 is in idle state, which indicates a reverse line polarity fault and igniter absent/open. A DC signal at the control input 120 when the control is in idle state indicates an 'Igniter Open in Reverse Line Polarity' fault.

Figure 9:
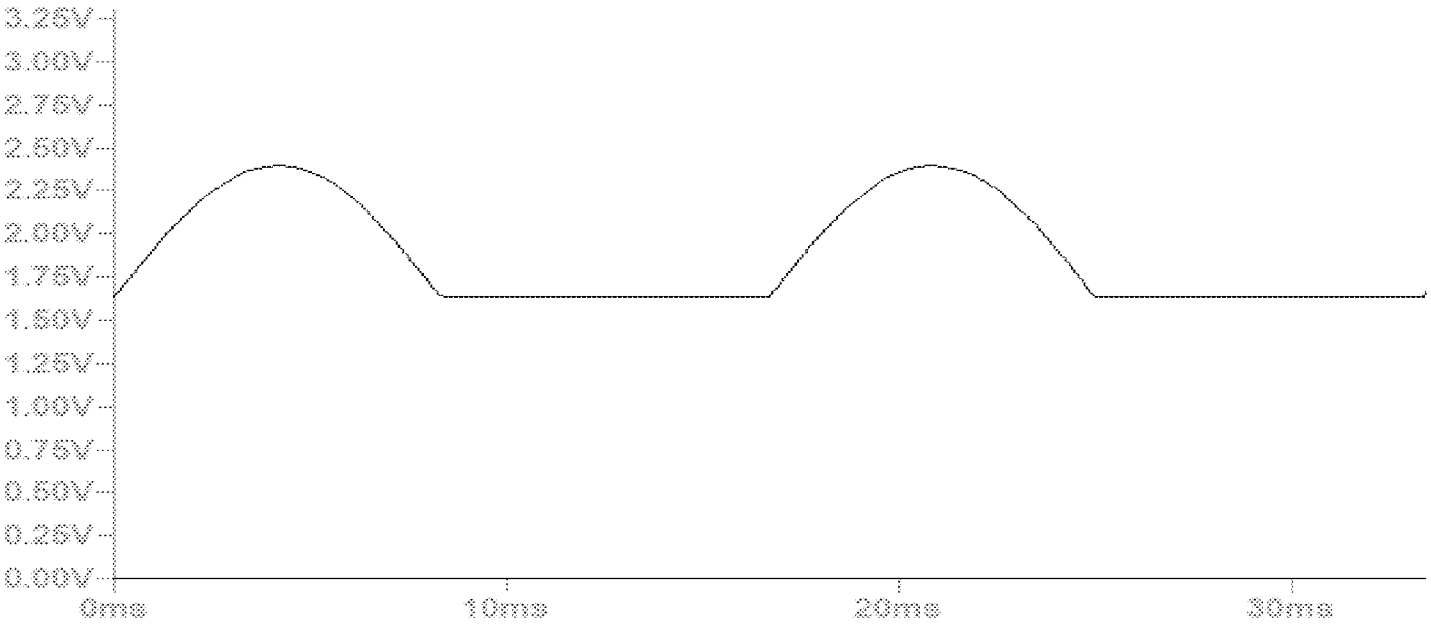
FIG. 9 illustrates a waveform of a signal at the input of the control shown in FIG. 1 in pre-purge state that indicates the inducer relay is ON and working properly.

FIG. 9 is a positive half-cycle waveform of a signal at the control input 120 when the control 100 is in pre-purge state that indicates the inducer relay 108 is ON and working properly.

When the inducer relay is ON, the following two faults are detectable: (1) Inducer Relay OFF when Inducer Relay should be ON, and (2) Igniter Relay ON when Igniter Relay should be OFF.

Figure 10:
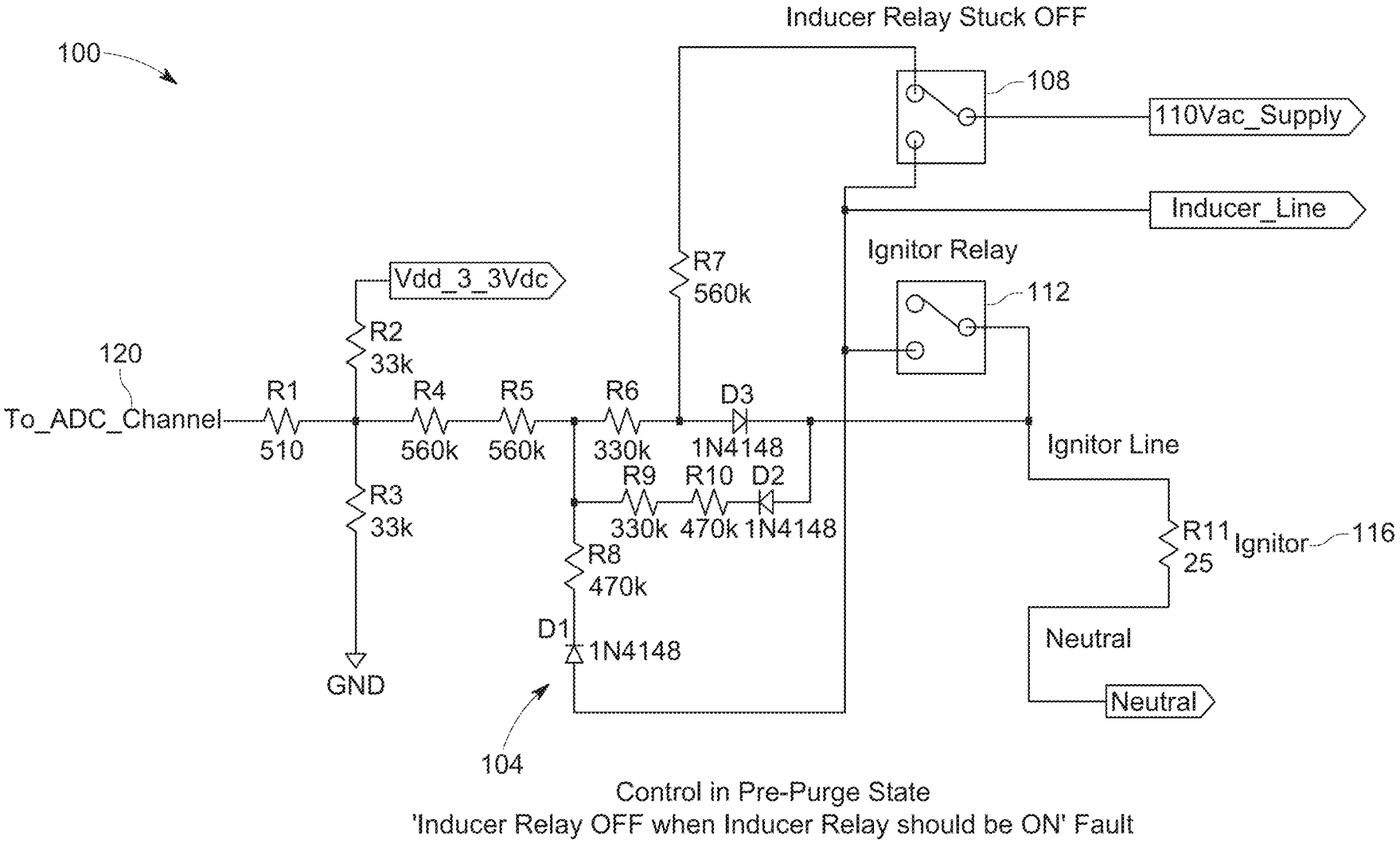

FIG. 10 illustrates the control 100 in pre-purge state when the inducer relay 108 is stuck OFF when the inducer relay 108 should be ON. See Table 4 below.

TABLE 4

| Inducer Relay OFF when Inducer Relay should be ON | |
|---|---|
| Which Relay | Relay actual status in hardware |
| Inducer Relay | Turned ON - Found OFF |
| Igniter Relay | OFF |
| Igniter | Present or Absent |
| Fault Detected → | Inducer Relay OFF when Inducer Relay should be ON |

Figure 11:
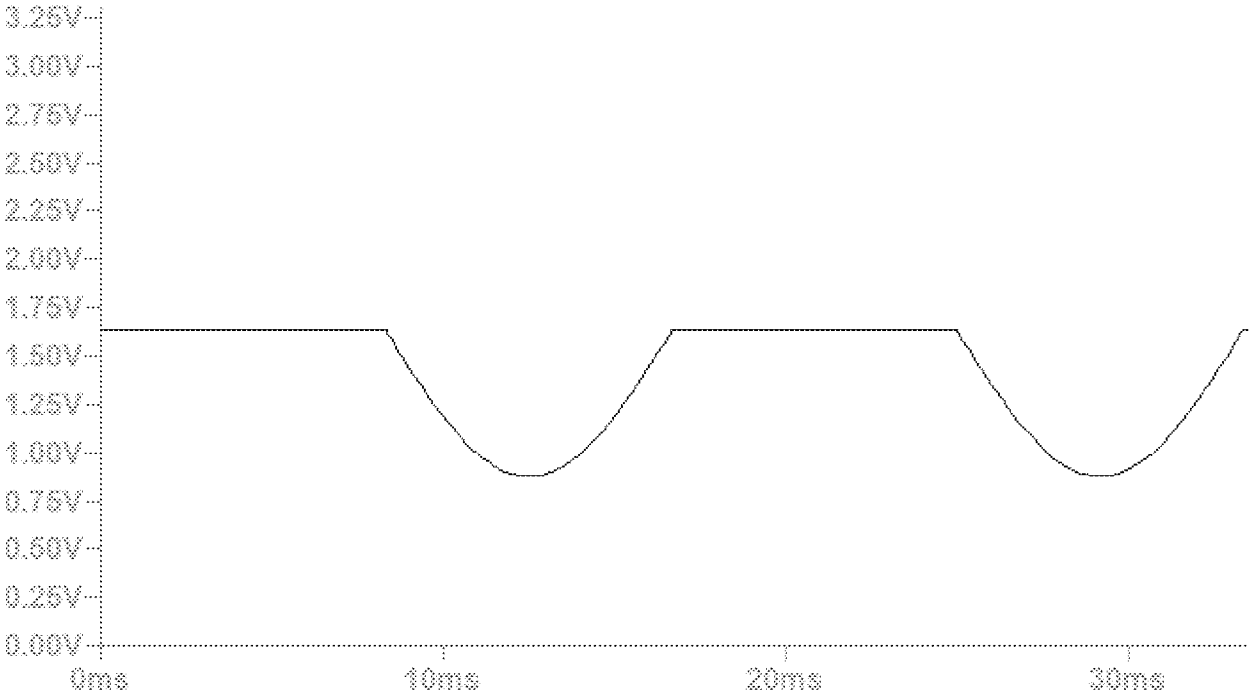
FIG. 11 illustrates a waveform of a signal at the input of the control shown in FIG. 10 in pre-purge state that indicates an 'Inducer Relay is OFF when Inducer Relay should be ON' fault.

FIG. 11 illustrates a negative half cycle waveform of a signal at the control input 120 when the control 100 is in pre-purge state, which indicates an 'Inducer Relay is OFF when Inducer Relay should be ON' fault. In pre-purge, the inducer relay 108 is turned ON and a positive half cycle should be obtained at the control input 120. But if there is a negative half cycle at the control input 120 with the control 100 in pre-purge state as shown in FIG. 11, this indicates an 'Inducer Relay OFF when Inducer Relay should be ON' fault. As shown in FIG. 2 and discussed above, the negative half cycle waveform should occur at the control input 120 when the inducer relay 108 is OFF as shown in FIG. 1.

Figure 12:
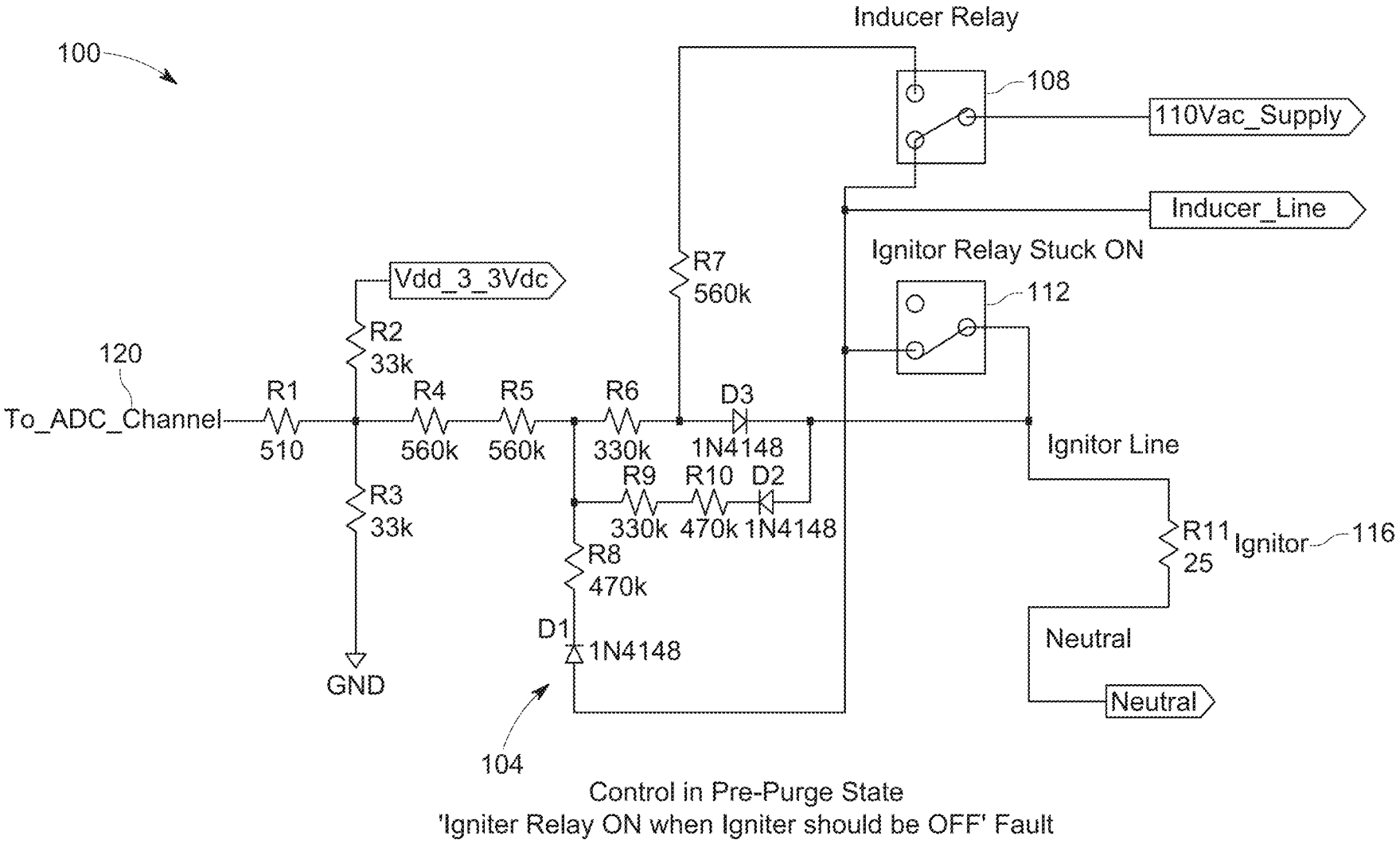
FIG. 12 is a circuit diagram of the control shown in FIG. 1, where the control is in pre-purge state and the igniter relay is stuck ON when the igniter relay should be OFF.

FIG. 12 illustrates the control 100 in pre-purge state when the igniter relay 112 is stuck ON when the igniter relay should be OFF. See Table 5 below.

TABLE 5

| Igniter relay ON when Igniter Relay should be OFF | |
|---|---|
| Which Relay | Relay actual status in hardware |
| Inducer Relay | ON |
| Igniter Relay | Turned OFF - Found ON |
| Igniter | Present or Absent |
| Fault Detected → | Igniter relay ON when it should be OFF |

Figure 13:
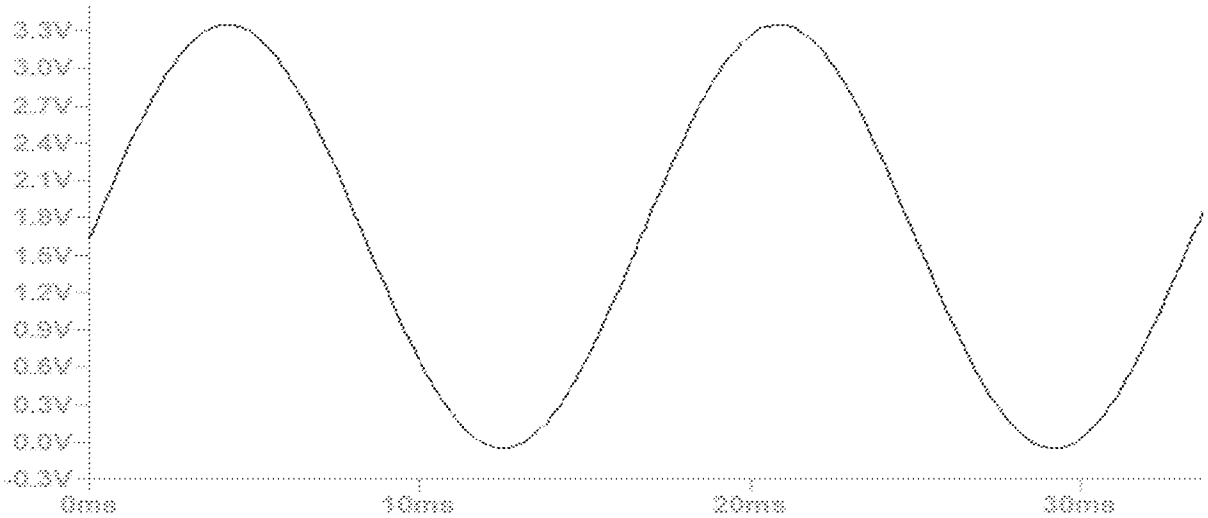
FIG. 13 illustrates a waveform of a signal at the input of the control shown in FIG. 10 in pre-purge state that indicates an 'Inducer Relay is OFF when Inducer Relay should be ON' fault.

FIG. 13 is a full cycle waveform of a signal at the control input 120 when the control 100 is in pre-purge state, which indicates an 'Igniter Relay is OFF when Igniter Relay should be ON' fault. When the inducer relay 108 is OFF, the igniter relay 112 has no influence on igniter open fault detection. When the inducer relay 108 is turned ON, the igniter 116 has no influence on igniter relay fault detection. Accordingly, this enables accurate fault detection (e.g., with 100% accuracy) because the signal waveform is either positive half cycle, negative half cycle, or full cycle, which means the signals are in digital form and not in analog form and thereby provide correct results.

Figure 14:
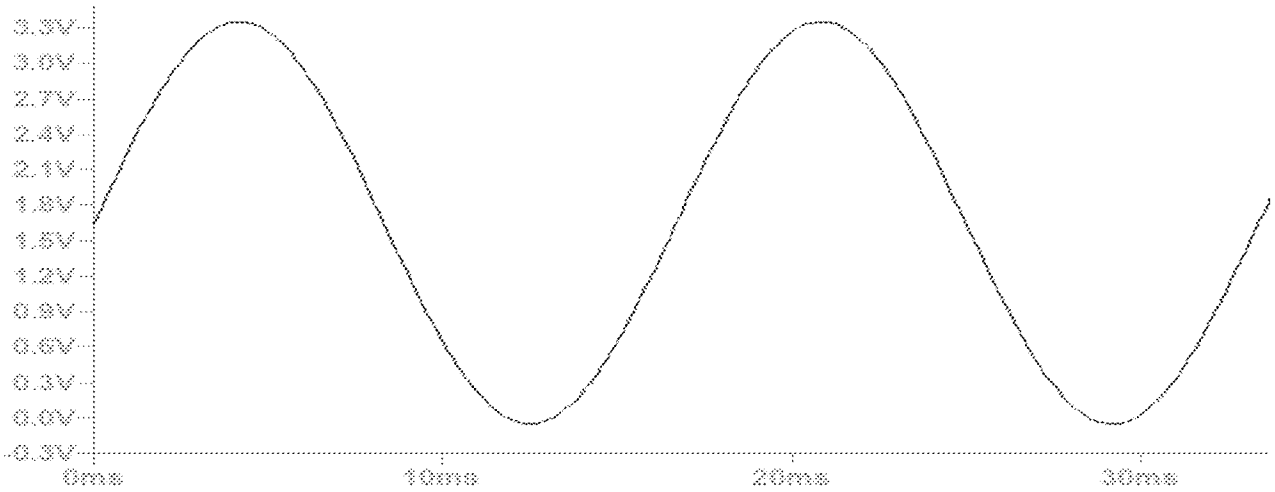
FIG. 14 illustrates a waveform of a signal at the input of the control shown in FIG. 1 in warm-up that indicates no faults.

FIG. 14 illustrates a full cycle waveform of a signal at the control input 120 when the control 100 is in igniter warm-up state, which indicates no faults. During igniter warm-up, the igniter relay 112 is turned on. When the igniter relay 112 is turned ON and is working properly, a full cycle signal is at the control input 120 as shown in FIG. 14.

Figure 15:
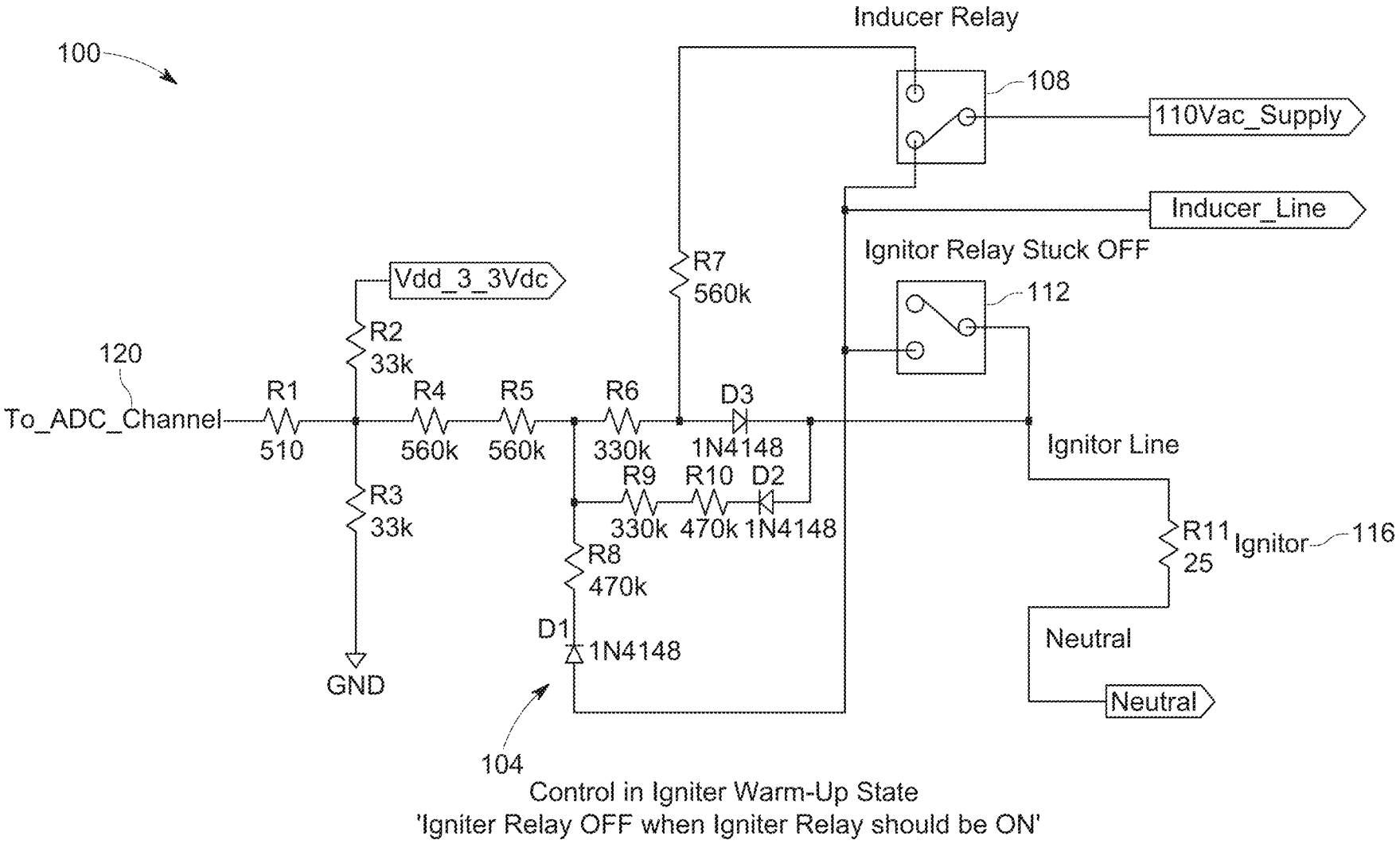

During warm-up, 'Igniter Relay OFF when Igniter Relay should be ON' fault is detectable. FIG. 15 illustrates the control 100 in igniter warm-up state when the igniter relay 112 is stuck OFF when the igniter relay 112 should be ON. See Table 6 below.

TABLE 6

| Igniter Relay OFF when Igniter Relay should be ON | |
|---|---|
| Which Relay | Relay actual status in hardware |
| Inducer Relay | ON |

TABLE 6-continued

| Igniter Relay OFF when Igniter Relay should be ON | |
|---|---|
| Which Relay | Relay actual status in hardware |
| Igniter Relay | Turned ON - Found OFF |
| Igniter | Present or Absent (No impact on Igniter relay fault detection) |
| Fault Detected → | Igniter Relay OFF when it should be ON |

Figure 16:
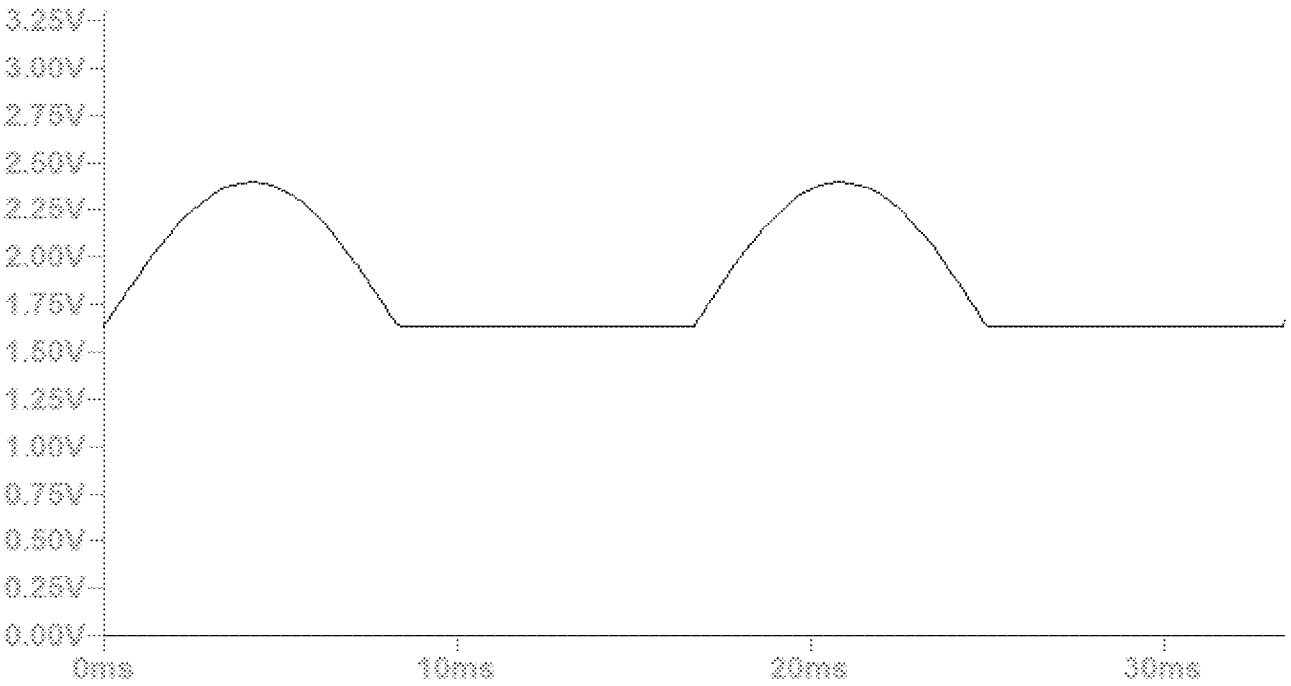
FIG. 16 illustrates a waveform of a signal at the input of the control shown in FIG. 15 in igniter warm-up that indicates an 'Igniter Relay OFF when Igniter Relay should be ON' fault.

FIG. 16 illustrates a positive half cycle waveform of a signal at the control input 120 when the control 100 is in igniter warm-up state, which indicates an 'Igniter Relay OFF when Igniter Relay should be ON' fault. If the igniter relay 112 remains OFF during igniter warm-up, then a positive half cycle is at the control input 120 as shown in FIG. 16.

If there is any grounding voltage, the grounding voltage can be measured as it appears in another half cycle in place of the half cycle filtered out. Accordingly, this exemplary embodiment allows for measuring of the grounding voltage whether the inducer relay is OFF or ON.

Figure 17:
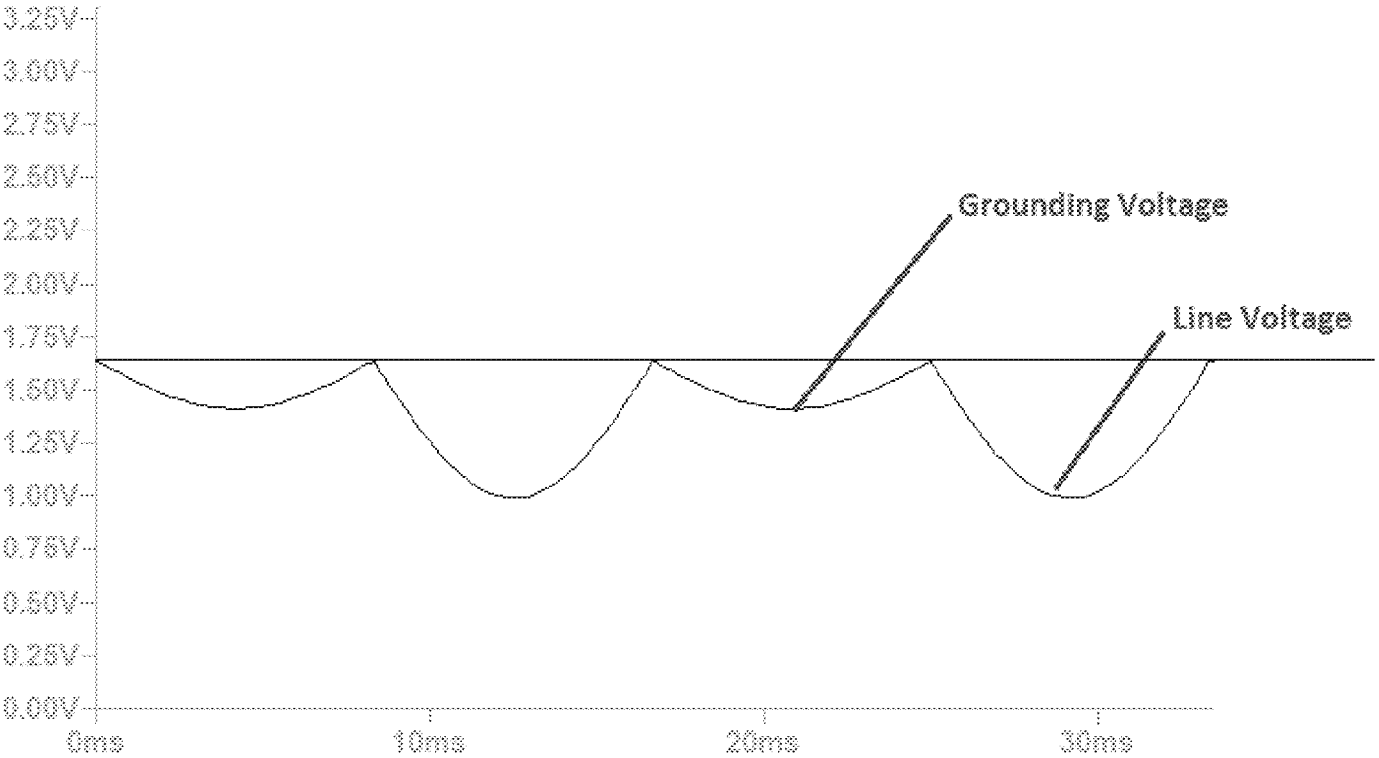
FIG. 17 illustrates a waveform of a signal at the input of the control shown in FIG. 1 when the inducer relay is OFF, and illustrating how grounding voltage and line voltage is determined from the negative cycle waveform.

FIG. 17 illustrates a waveform of a signal at the control input 120 when the inducer relay is OFF. As shown in FIG. 17, the grounding voltage is the voltage (e.g., about 1.4 volts, etc.) on the vertical Y axis that corresponds with the smaller amplitude of the negative cycle waveform. The line voltage is the voltage (e.g., about 1 volt, etc.) on the vertical Y axis that corresponds with the larger amplitude of the negative cycle waveform.

Figure 18:
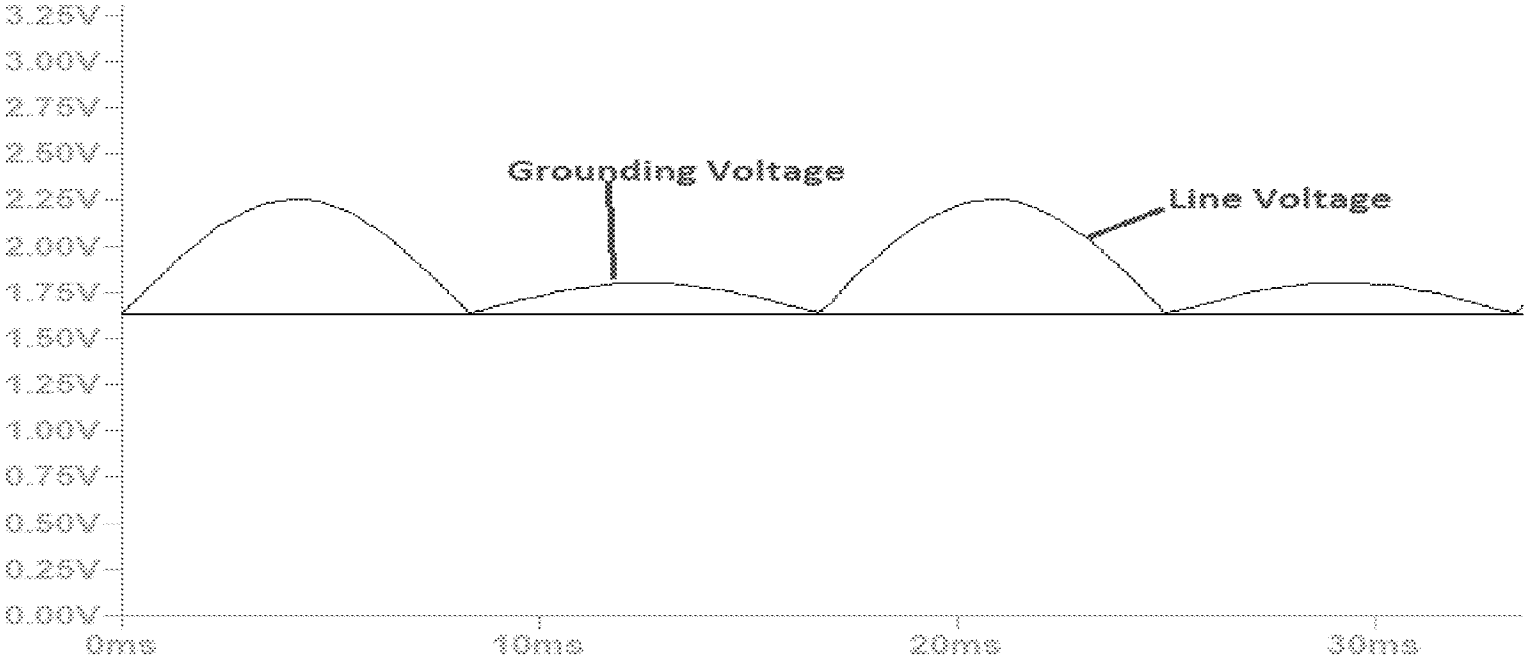
FIG. 18 illustrates a waveform of a signal at the input of the control shown in FIG. 1 when the inducer relay is ON, and illustrating how grounding voltage and line voltage is determined from the positive cycle waveform.

FIG. 18 illustrates a waveform of a signal at the input of the control input 120 when the inducer relay is ON. As shown in FIG. 18, the grounding voltage is the voltage (e.g., about 1.75 volts, etc.) on the vertical Y axis that corresponds with the smaller amplitude of the positive cycle waveform. The line voltage is the voltage (e.g., about 2.25 volts, etc.) on the vertical Y axis that corresponds with the larger amplitude of the positive cycle waveform.

FIG. 19 is a circuit diagram of a control 200 including a circuit assembly 204 enabling use of diode rectification to determine igniter, inducer relay, and igniter relay faults according to an alternative exemplary embodiment of the present disclosure. In this alternative exemplary embodiment, the direction of the diodes D1, D2, D3 has been reversed as compared to the diodes D1, D2, D3 in the circuit assembly 104 shown in FIG. 1. In FIG. 19, the diodes D1, D2, and D3 are circled merely for easier identification in FIG. 19.

As shown in FIG. 19, the control 200 is in idle state, the inducer relay 204 and igniter relay 208 are OFF, and the igniter 216 is installed. In this alternative embodiment, the positive half cycle waveforms (e.g., FIGS. 4, 9, 16, 18) would change from positive half cycle to negative half cycle at the control input 220. And the negative half cycle waveforms (e.g., FIGS. 2, 11, 17) would change from negative half cycle to positive half cycle at the control input 220 for detection of relay faults. For reverse polarity (e.g., FIG. 7), negative half cycle would have less amplitude than positive cycle.

The igniter 116 may comprise any suitable igniter, including a hot surface igniter (e.g., electric resistance igniter, etc.) usable to ignite combustible gas in a furnace of an HVAC system. For example, the igniter 116 may comprise a hot surface igniter adapted to, in response to receiving a current, heat up to ignite a combustible gas of a furnace. In this example, the hot surface igniter may include any suitable resistive igniter, etc., and is adapted to ignite the combustible gas of the furnace via heat when the hot surface igniter is supplied with a current. For example, during normal operation, the hot surface igniter may be turned on, etc., to start, initiate, etc., a combustion process of the furnace (e.g., in response to a thermostat call for heat, etc.).

The control 100 may be configured to perform operations using any suitable combination of hardware and software. For example, the control may include any suitable circuitry, logic gates, microprocessor(s), computer-executable instructions stored in memory, etc., operable to cause the control 100 to perform actions disclosed herein.

Exemplary embodiments disclosed herein should not be limited to any particular igniter, furnace, or HVAC system as exemplary embodiments disclosed herein may be implemented in various controls and systems, e.g., HVAC systems, gas powered appliances, furnaces, other devices/systems that use an AC signal, integrated furnace controls (IF), thermostats, etc. Example embodiments disclosed herein may allow furnace control boards, etc., to detect and determine whether a hot surface igniter is faulty, whether an igniter relay is faulty, or whether an inducer relay is faulty. This may allow a technician to determine whether a control board should be replaced, or whether only the hot surface igniter needs to be replaced. This may allow for reduced repair time, reduced repair cost, etc.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "includes," "including," "has," "have," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A circuit assembly comprising a plurality of diodes, the circuit assembly configured to be coupled to an inducer relay, an igniter relay, and an igniter such that diode rectification is usable for detecting and distinguishing between a failure of the igniter, a failure of the inducer relay, and a failure of the igniter relay for a given one of a plurality of operational states as determined by whether a waveform of a signal at an input is a full cycle waveform, a positive half cycle waveform, or a negative half cycle waveform.

2. The circuit assembly of claim 1, wherein the plurality of diodes comprises:

a first diode coupled in series with the input;

a second diode coupled in series with the input; and a third diode coupled in parallel with the second diode and coupled in series with the input.

3. The circuit assembly of claim 2, wherein the circuit assembly includes:

at least a first resistance coupled in series with the first diode;

at least a second resistance coupled in series with the second diode; and at least a third resistance coupled in series with the third diode.

4. The circuit assembly of claim 2, wherein the circuit assembly includes:

a first node coupled with the input and the first, second, and third diodes;

a second node coupled with the first node and the first and second diodes;

a third node coupled with the second and third diodes and configured to be coupled with the igniter relay and the igniter; and a fourth node coupled with the third diode and the input and configured to be coupled with inducer relay.

5. The circuit assembly of claim 1, wherein the plurality of operational states include an idle state, a pre-purge state, and an igniter warm-up state.

6. The circuit assembly of claim 1, wherein the circuit assembly is configured such that:

a negative half cycle waveform of the signal at the input is indicative of a normal operating condition or no failure of the igniter, the inducer relay, and the igniter relay when the operational state is an idle state and the inducer relay and igniter relay are OFF;

a positive half cycle waveform of the signal at the input is indicative of a failure of the inducer relay being ON when the inducer relay should be OFF and when the operational state is an idle state and the igniter relay is OFF; and a full cycle waveform of the signal at the input is indicative of a failure of the igniter being absent or open when the inducer relay is OFF and the operational state is an idle state regardless of whether the igniter relay is either ON or OFF.

7. The circuit assembly of claim 1, wherein the circuit assembly is configured such that:

a full cycle waveform of the signal at the input having different positive and negative half cycle amplitudes is indicative of a reverse line polarity fault and that the igniter is present when the operational state is an idle state; and a DC signal at the input is indicative of a reverse line polarity fault and a failure of the igniter being absent or open when the operational state is an idle state.

8. The circuit assembly of claim 1, wherein the circuit assembly is configured such that:

a positive half-cycle waveform of the signal at the input is indicative of a normal operating condition of the inducer relay when the inducer relay is ON and the operational state is a pre-purge state;

a negative half-cycle waveform of the signal at the input is indicative of a failure of the inducer relay being OFF when the inducer relay should be ON and when the operational state is a pre-purge state and the igniter relay is OFF; and a full cycle waveform of the signal at the input is indicative of a failure of the igniter relay being ON when the igniter relay should be OFF and when the operational state is a pre-purge state and the inducer relay is ON.

9. The circuit assembly of claim 1, wherein the circuit assembly is configured such that:

a full cycle waveform of the signal at the input is indicative of a normal operating condition or no failure of the igniter, the inducer relay, and the igniter relay when the operational state is an igniter warm-up state and the inducer relay is ON; and a positive half-cycle waveform of the signal at the input is indicative of a failure of the igniter relay being OFF when the igniter relay should be ON and when the operational state is a pre-purge state and the inducer relay is ON.

10. The circuit assembly of claim 1, wherein the circuit assembly is configured to allow for measuring of grounding voltage whether the inducer relay is OFF or ON as determined by an amplitude of a lower amplitude half cycle of the waveform of the signal at the input that appears in place of a filtered out half cycle waveform, the amplitude of the lower amplitude half cycle corresponding with the grounding voltage.

11. The circuit assembly of claim 1, wherein the circuit assembly is configured such that:

a negative half cycle waveform of the signal at the input is indicative of a normal operating condition or no failure of the igniter, the inducer relay, and the igniter relay when the operational state is an idle state and the inducer relay and igniter relay are OFF;

a positive half cycle waveform of the signal at the input is indicative of a failure of the inducer relay being ON when the inducer relay should be OFF and when the operational state is an idle state and the igniter relay is OFF;

a full cycle waveform of the signal at the input is indicative of a failure of the igniter being absent or open when the inducer relay is OFF and the operational state is an idle state regardless of whether the igniter relay is either ON or OFF;

a full cycle waveform of the signal at the input having different positive and negative half cycle amplitudes is indicative of a reverse line polarity fault and that the igniter is present when the operational state is an idle state;

a DC signal at the input is indicative of a reverse line polarity fault and a failure of the igniter being absent or open when the operational state is an idle state;

a positive half-cycle waveform of the signal at the input is indicative of a normal operating condition of the inducer relay when the inducer relay is ON and the operational state is a pre-purge state;

a negative half-cycle waveform of the signal at the input is indicative of a failure of the inducer relay being OFF when the inducer relay should be ON and when the operational state is a pre-purge state and the igniter relay is OFF;

a full cycle waveform of the signal at the input is indicative of a failure of the igniter relay being ON when the igniter relay should be OFF and when the operational state is a pre-purge state and the inducer relay is ON;

a full cycle waveform of the signal at the input is indicative of a normal operating condition or no failure of the igniter, the inducer relay, and the igniter relay when the operational state is an igniter warm-up state and the inducer relay is ON; and a positive half-cycle waveform of the signal at the input is indicative of a failure of the igniter relay being OFF when the igniter relay should be ON and when the operational state is a pre-purge state and the inducer relay is ON.

12. A control for a system comprising the circuit assembly of claim 1.

13. The control of claim 12, wherein:

the control comprises the inducer relay, the igniter relay, and the igniter; and the circuit assembly is coupled to the inducer relay, the igniter relay, and the igniter of the control.

14. A circuit assembly comprising a plurality of diodes, the circuit assembly configured to be coupled to an inducer relay, an igniter relay, and an igniter to enable detection of and distinguishing between a failure of the igniter, a failure of the inducer relay, and a failure of the igniter relay as determined by a waveform of a signal at an input for a given one of a plurality of operational states including an idle state, a pre-purge state, and an igniter warm-up state.

15. The circuit assembly of claim 14, wherein the plurality of diodes comprises:

a first diode coupled in series with the input;

a second diode coupled in series with the input; and a third diode coupled in parallel with the second diode and coupled in series with the input.

16. The circuit assembly of claim 15, wherein the circuit assembly includes:

at least a first resistance coupled in series with the first diode;

at least a second resistance coupled in series with the second diode; and at least a third resistance coupled in series with the third diode.

17. The circuit assembly of claim 15, wherein the circuit assembly includes:

a first node coupled with the input and the first, second, and third diodes;

a second node coupled with the first node and the first and second diodes;

a third node coupled with the second and third diodes and configured to be coupled with the igniter relay and the igniter; and a fourth node coupled with the third diode and the input and configured to be coupled with inducer relay.

18. The circuit assembly of claim 14, wherein the circuit assembly is configured such that:

a negative half cycle waveform of the signal at the input is indicative of a normal operating condition or no failure of the igniter, the inducer relay, and the igniter relay when the operational state is the idle state and the inducer relay and igniter relay are OFF;

a positive half cycle waveform of the signal at the input is indicative of a failure of the inducer relay being ON when the inducer relay should be OFF and when the operational state is the idle state and the igniter relay is OFF;

a full cycle waveform of the signal at the input is indicative of a failure of the igniter being absent or open when the inducer relay is OFF and the operational state is the idle state regardless of whether the igniter relay is either ON or OFF;

a full cycle waveform of the signal at the input having different positive and negative half cycle amplitudes is indicative of a reverse line polarity fault and that the igniter is present when the operational state is the idle state;

a DC signal at the input is indicative of a reverse line polarity fault and a failure of the igniter being absent or open when the operational state is the idle state;

a positive half-cycle waveform of the signal at the input is indicative of a normal operating condition of the inducer relay when the inducer relay is ON and the operational state is the pre-purge state;

a negative half-cycle waveform of the signal at the input is indicative of a failure of the inducer relay being OFF when the inducer relay should be ON and when the operational state is the pre-purge state and the igniter relay is OFF;

a full cycle waveform of the signal at the input is indicative of a failure of the igniter relay being ON when the igniter relay should be OFF and when the operational state is the pre-purge state and the inducer relay is ON;

a full cycle waveform of the signal at the input is indicative of a normal operating condition or no failure of the igniter, the inducer relay, and the igniter relay when the operational state is the igniter warm-up state and the inducer relay is ON; and a positive half-cycle waveform of the signal at the input is indicative of a failure of the igniter relay being OFF when the igniter relay should be ON and when the operational state is the pre-purge state and the inducer relay is ON.

19. The circuit assembly of claim 14, wherein the circuit assembly is configured to allow for measuring of grounding voltage whether the inducer relay is OFF or ON as determined by an amplitude of a lower amplitude half cycle of the waveform of the signal at the input that appears in place of a filtered out half cycle waveform, the amplitude of the lower amplitude half cycle corresponding with the grounding voltage.

20. A control for a system comprising the circuit assembly of claim 14.

21. The control of claim 20, wherein:

the control comprises the inducer relay, the igniter relay, and the igniter; and the circuit assembly is coupled to the inducer relay, the igniter relay, and the igniter of the control.

22. A method of determining inducer relay, igniter relay, and igniter failures with a circuit assembly comprising a plurality of diodes and configured to be coupled to an inducer relay, an igniter relay, and an igniter, the method comprising using diode rectification to detect and distinguish between a failure of an igniter, a failure of the inducer relay, and a failure of the igniter relay by determining whether a waveform of a signal at an input is a full cycle waveform, a positive half cycle waveform, or a negative half cycle waveform for a given one of a plurality of operational states.

23. The method of claim 22, wherein the method includes:

determining there is no failure of the igniter, the inducer relay, and the igniter relay based on a negative half cycle waveform of the signal at the input when the operational state is an idle state and the inducer relay and igniter relay are OFF based on a negative half cycle waveform;

determining there is a failure of the inducer relay being ON when the inducer relay should be OFF based on a positive half cycle waveform of the signal at the input when the operational state is an idle state and the igniter relay is OFF;

determining there is a failure of the igniter being absent or open based on a full cycle waveform of the signal at the input when the operational state is an idle state and when the inducer relay is OFF regardless of whether the igniter relay is either ON or OFF;

determining there is a reverse line polarity fault based on a full cycle waveform of the signal at the input having different positive and negative half cycle amplitudes when the operational state is an idle state and the igniter present;

determining there is a reverse line polarity fault and a failure of the igniter being absent or open based on a DC signal at the input when the operational state is an idle state;

determining there is no failure of the inducer relay based on a positive half-cycle waveform of the signal at the input when the operational state is a pre-purge state and the inducer relay is ON;

determining there is a failure of the inducer relay being OFF when the inducer relay should be ON based on a negative half-cycle waveform of the signal at the input when the operational state is a pre-purge state and the igniter relay is OFF; and determining there is a failure of the igniter relay being ON when the igniter relay should be OFF based on a full cycle waveform of the signal at the input when the operational state is a pre-purge state and the inducer relay is ON;

determining there is no failure of the igniter, the inducer relay, and the igniter relay based on a full cycle waveform of the signal at the input when the operational state is an igniter warm-up state and the inducer relay is ON; and determining there is a failure of the igniter relay being OFF when the igniter relay should be ON based on a positive half-cycle waveform of the signal at the input when the operational state is an igniter warm-up state and the inducer relay is ON.

24. The method of claim 22, further comprising measuring grounding voltage whether the inducer relay is OFF or ON by filtering out a half cycle waveform of the signal at the input and determining an amplitude of a lower amplitude half cycle of the waveform of the signal at the input that corresponds with the grounding voltage.

* * * * *